US010648273B2

(12) United States Patent
Krieg et al.

(10) Patent No.: US 10,648,273 B2
(45) Date of Patent: May 12, 2020

(54) INFLATABLE PACKER INTERNAL PRESSURE COMPENSATION ASSEMBLY

(71) Applicant: Baker Hughes, a GE company, LLC, Houston, TX (US)

(72) Inventors: George N. Krieg, Broussard, LA (US); Frank J. Jupena, Lafayette, LA (US); John K. Cinnater, Jr., Broussard, LA (US); Joseph Puryear, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/889,965

(22) Filed: Feb. 6, 2018

(65) Prior Publication Data

US 2019/0242210 A1 Aug. 8, 2019

(51) Int. Cl.

| | |
|---|---|
| ***E21B 33/127*** | (2006.01) |
| ***E21B 47/06*** | (2012.01) |
| ***E21B 47/00*** | (2012.01) |
| ***E21B 33/129*** | (2006.01) |
| *E21B 47/12* | (2012.01) |

(52) U.S. Cl.

CPC ..... *E21B 33/1275* (2013.01); *E21B 33/1292* (2013.01); *E21B 47/0007* (2013.01); *E21B 47/06* (2013.01); *E21B 47/12* (2013.01)

(58) Field of Classification Search

CPC ..... E21B 33/127; E21B 33/1272; E21B 33/1275; E21B 33/1208

See application file for complete search history.

(56) References Cited

U.S. PATENT DOCUMENTS

| | | | | |
|---|---|---|---|---|
| 5,277,253 | A * | 1/1994 | Giroux | E21B 33/128 166/187 |
| 5,549,165 | A | 8/1996 | Brooks | |
| 6,119,775 | A | 9/2000 | Drechsler et al. | |
| 6,164,378 | A | 12/2000 | Coronado | |
| 6,289,994 | B1 | 9/2001 | Willauer | |
| 2004/0173363 | A1* | 9/2004 | Navarro-Sorroche | E21B 33/127 166/387 |
| 2006/0248949 | A1* | 11/2006 | Gregory | E21B 33/1243 73/152.51 |
| 2010/0018714 | A1* | 1/2010 | Merlau | E21B 23/04 166/319 |
| 2011/0061862 | A1* | 3/2011 | Loretz | E21B 33/1208 166/250.11 |

(Continued)

*Primary Examiner* — Kristyn A Hall

(74) *Attorney, Agent, or Firm* — Shawn Hunter

(57) ABSTRACT

An inflatable packer assembly features a pump and a piping network configurable to add fluid or remove fluid from the inflatable. Sensor can detect borehole variables and transmit readings to a remote location. Commands can be sent from the remote location to a borehole controller to configure the piping system for addition or removal of fluid from the inflatable to a desired level. A power source can power the pump and automatic valves to configure the system for addition or removal of fluid. Control from a remote location can be manual or automatic based on algorithms loaded on a processor that can be remotely locally located by the inflatable. A reservoir with clean fluid that is in pressure balance with borehole fluids can be used with a fluid separation device between clean and well fluids. Well fluids can be screened before being delivered to the inflatable.

18 Claims, 2 Drawing Sheets

(56) References Cited

U.S. PATENT DOCUMENTS

| | | | | |
|---|---|---|---|---|
| 2014/0166277 | A1* | 6/2014 | Ade-Fosudo ..... | E21B 33/1275<br>166/250.17 |
| 2014/0174733 | A1* | 6/2014 | Gadot ..... | E21B 41/0085<br>166/264 |
| 2016/0237775 | A1 | 8/2016 | O'Malley | |

* cited by examiner

INFLATABLE PACKER INTERNAL PRESSURE COMPENSATION ASSEMBLY

FIELD OF THE INVENTION

The field of the invention is inflatable packers and more particularly those that have compensation systems for internal pressure that can be actuated to change the internal pressure in the inflatable element based on change in downhole conditions.

BACKGROUND OF THE INVENTION

Inflatable packers are actuated with applied pressure through a valve assembly once placed in the desired borehole locations. Once set such devices are exposed to potential changes in borehole temperature and pressure that can affect the performance of the inflatable element against the borehole wall. These changes in well conditions affect the internal pressure in the inflatable element and various designs were proposed that passively responded to changes in internal pressure in the set inflatable element with movable compensating pistons that increased the internal inflatable pressure when pressure increased below the inflatable, for example. The increased borehole pressure moved the compensating piston to reduce the inflatable volume and raise its internal pressure. If the situation reversed, the compensating piston could move in an opposite direction to increase the inflatable volume and reduce the internal pressure. There were also provisions to avoid internal overpressure of the inflatable element by use of pressure relief devices that could change the volume or release some internal pressure in the inflated element. Typical of such passive compensation systems are U.S. Pat. Nos. 6,289,994; 6,164,378; 6,119,775; 5,549,165 and US 20160237775.

The present invention addresses a proactive approach to pressure compensation in the inflated packer. It features a power supply coupled to a pump that can be triggered and a piping network that is configurable to pump fluids into the inflated element or to remove fluid from the inflated element. The pressure in the inflated element and below the element in the borehole can be sensed and those pressures transmitted to a local (downhole) or remote location such as a surface location. Other variables can also be sensed such as borehole temperature. A control module includes transmission capability from the borehole to the remote location of measured variables and a signal receiving capability to execute commands such as reconfiguration of the closed or open fluid system that can add or remove fluid. Alternatively borehole fluid can be screened before being pumped into the inflatable while fluid removed from the inflatable can be pumped directly into the borehole for compensation of the internal pressure in the inflatable responsive to well conditions. Power can come from a battery pack or if otherwise available in the borehole can be used to power the components of the active control system that can adjust the internal pressure in the inflatable per a local downhole algorithm or the needs of surface personnel for well control using the inflatable. The sealing capability is continuously maintained and the internal pressure can be controlled as desired in response to transmitted well conditions or, at the discretion of surface personnel or remote control equipment independently of changing variables at the set inflatable location, making the control system an active control system set apart from the passive designs used in the past. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

An inflatable packer assembly features a pump and a piping network configurable to add fluid or remove fluid from the inflatable. Sensor can detect borehole variables and transmit readings to a location. Commands can be sent from the location to a borehole controller to configure the piping system for addition or removal of fluid from the inflatable to a desired level. A power source can power the pump and automatic valves to configure the system for addition or removal of fluid. Pressure increases can also be mitigated with the use of a pressure relief valve. Control from a remote location can be manual or automatic based on algorithms loaded on a processor that can be remotely locally located by the inflatable. A reservoir with fluid that is in pressure balance with borehole fluids can be used with a fluid separation device between clean and well fluids. Well fluids can be screened before being delivered to the inflatable.

DETAILED DESCRIPTION OF THE PREFERRED EMBODIMENT

Figure 1:
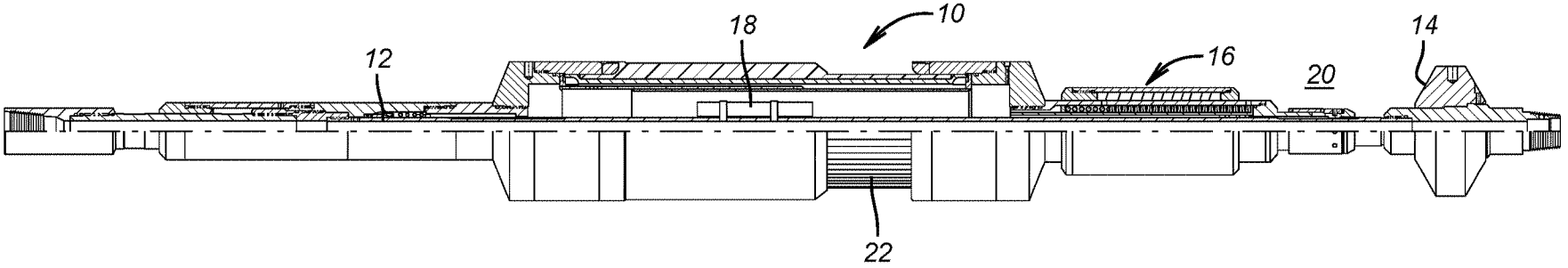
FIG. 1 is a schematic illustration of a local control compensation system for an inflatable.
Figure 2:
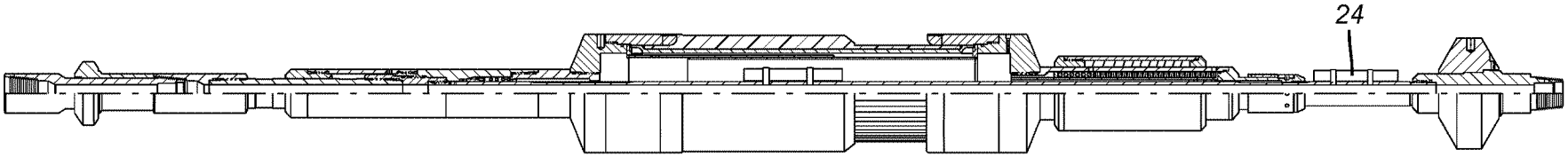
FIG. 2 is a schematic illustration of a remote operation variation of the system of FIG.

FIG. 1 shows a known inflatable packer 10 on a mandrel 12 with a bottom guide 14 at a lower end. Assembly 24 is the control system shown in more detail in FIG. 3. In the FIG. 1 configuration, sensor 18 is within the inflatable 10 and borehole 20 pressure is sensed locally by the pressure regulation assembly 16 for adjustments of the internal pressure in the inflatable element 22. FIG. 2 schematically shows a transmitter/signal receiver that can be used if commands are given from a remote location responsive to data sent from the borehole to regulate the pressure inside the inflatable element 22. Such signals can be at least one of acoustic wireless telemetry, electromagnetic based wireless telemetry, electrical wires and/or fiber.

Figure 3:
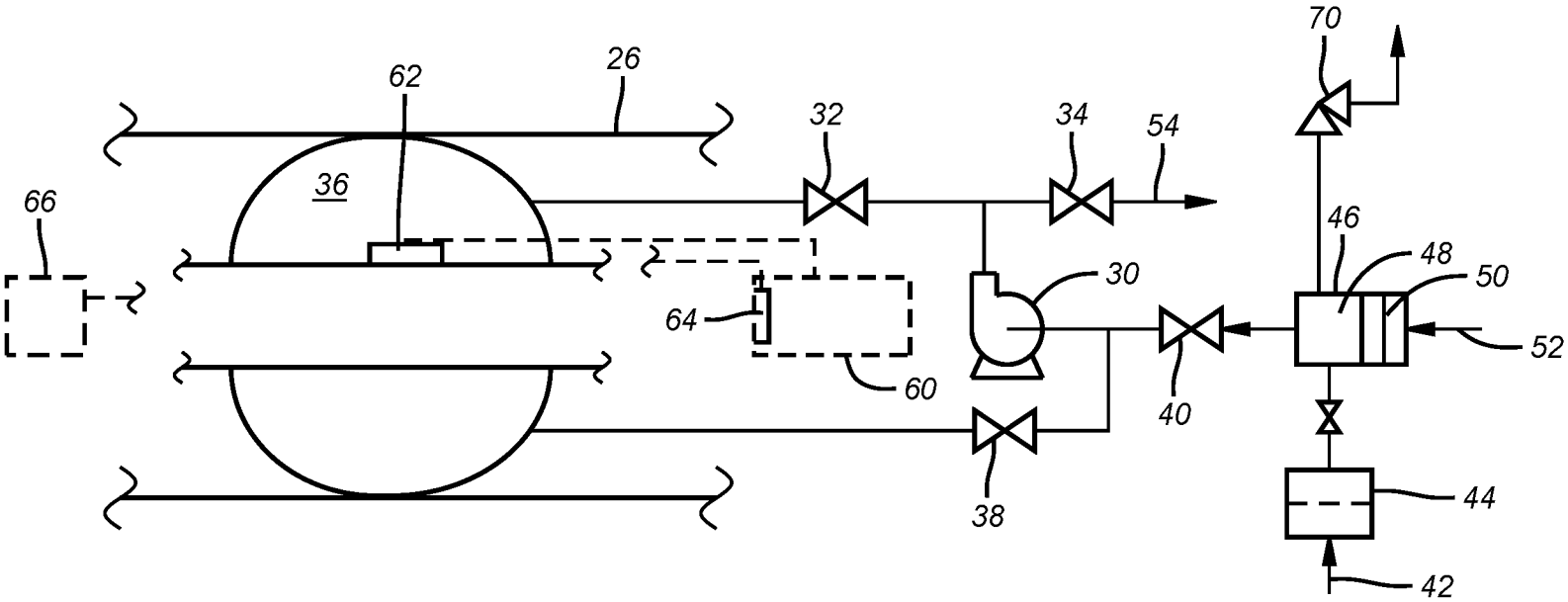
FIG. 3 is a diagram of different configurations of the systems of FIGS. 1 and 2 shown in greater detail.

The system is shown in more detail in FIG. 3 where the inflatable 10 is set against a borehole wall 26. Pump 30 is connected to valves 32 and 34 that are schematically illustrated valves with powered operators. When increasing the pressure in volume 36 within the inflatable element 22 valve 32 is opened and valve 34 is closed. Valve 38 is closed and valve 40 is open. Two options for fluid addition are illustrated together in FIG. 3 although their use is in the alternative. Well fluid represented by arrow 42 can go through a screen 44 and through valve 40 into pump 30 to boost the pressure in volume 36. Alternatively a reservoir 46 can hold fluid 48 on one side of a fluid separation device 50. The other side of fluid separation device 50 is exposed to borehole fluid above or below the inflatable 10 as represented by arrow 52 the discharge from volume 36 represented by arrow 54 can be directed back into reservoir 46 for a closed system of clean fluid. When that occurs the fluid separation device 50 shifts to the left with valves 40 and 32 open and valve 38 closed as pressure in volume 36 builds.

When pumping fluid out of volume 36 valve 38 is open as is valve 34 and valve 32 is closed. The fluid separation device 50 will shift right as fluid is pumped into chamber 46. As an alternative the fluid pumped out of volume 36 can go to the borehole 20 but this will result in loss of fluid each time fluid is pumped out of volume 36.

A control module 60 is illustrated schematically. It can communicate with sensors 62 and 64 for respective conditions within the element 22 and in the borehole 20 below the inflatable 10. Sensors above the inflatable are also envisioned. The sensors can measure pressure or/and temperature or other variables as desired. The module 60 can have battery power or if there is an alternative power source already in the borehole then power can be obtained that way. A processor can be integrated into the module 60 so that control is strictly local responsive to local readings of pressure and temperature, for example, to operate the valves discussed above for addition or removal of pressure from within volume 36. Alternatively the module 60 can include signal transmitters to send data in real time to a remote processor 66, such as at a surface location, for example, so that commands from the remote location can be sent into the borehole 20 to configure the piping system as needed for addition or removal of pressure from volume 36. Such pressure changes to the volume 36 can be controlled with surface personnel providing input, for example, or by an algorithm in the processor 66 that adjusts commands to maintain a predetermined pressure in volume 36. In this manner changes in well conditions can be monitored in real time for a more rapid response that will prevent a seal failure at the inflatable due to such operating changes in the borehole below or above the inflatable. Alternatively, the collected data can be stored and then recovered at the surface when the control module 60 is removed from the well.

Those skilled in the art will appreciate that the assembly represents a move into active real time control of an inflatable, which is a step beyond the passive and hence reactive systems of the past. Changes to the system are contemplated such as the use of 3 way valves to reduce the number of valves in the piping system so that it takes up less space and is less expensive to assemble. Flow out of the inflatable can be accomplished without pumping. Either way, the capability of moving fluid into or out of an inflatable with motive force locally located adds a degree of confidence to the inflatable operation in varying conditions in the borehole and an ability to react to them in real time either automatically or manually. The system is proactive rather than past reactive systems. A fluid can be used to avoid contamination from debris in well fluids or a filter can be used to allow the use of well fluids. A relief valve 70 can be mounted to reservoir 46 for thermally induced pressure relief.

The above description is illustrative of the preferred embodiment and many modifications may be made by those skilled in the art without departing from the invention whose scope is to be determined from the literal and equivalent scope of the claims below:

We claim:

1. An inflatable packer assembly, comprising:

a mandrel mounted inflatable element;

a pressure regulation assembly associated with said inflatable element, said pressure regulation assembly comprising at least one sensor outside of the inflatable element to detect borehole pressure or temperature;

a fluid reservoir operably associated with the pressure regulation assembly for supplying screened wellbore fluid to the inflatable element as dictated by the pressure regulation assembly and based at least partially on detected borehole pressure or temperature.

2. The assembly of claim 1, wherein:

said pressure regulation assembly is operated remotely from said inflatable element.

3. The assembly of claim 1, wherein:

said pressure regulation assembly is operated locally adjacent said inflatable element.

4. The assembly of claim 1, wherein:

said pressure regulation assembly comprises at least one pump.

5. The assembly of claim 4, wherein:

said pump connected to a piping network configurable to allow the pump to deliver fluid into said inflatable element or remove fluid from said inflatable element.

6. The assembly of claim 5, wherein:

power for said pump comprises an adjacently mounted power supply.

7. The assembly of claim 1, wherein:

said pressure regulation assembly comprises at least one sensor in said inflatable element.

8. The assembly of claim 7, wherein:

said at least one sensor outside said inflatable element comprises a pressure sensor located downhole from said inflatable element.

9. The assembly of claim 8, wherein:

said pressure regulation assembly further comprises a processor located adjacent to said inflatable element operably connected to said sensors which detect pressure and comprising an algorithm to regulate pressure in said inflatable element using reading from said sensors and a locally mounted pump.

10. The assembly of claim 9, wherein:

said pump is powered with a power supply.

11. The assembly of claim 8, wherein:

said at least one sensor in said inflatable element and said at least one sensor outside said inflatable element are each connected to at least one transmitter to send sensed signals to a remote location from said inflatable element and at least one receiver to receive at least one signal from said remote location for remote controlling of pressure in said inflatable element.

12. The assembly of claim 11, wherein:

a processor at said remote location is operably connected to said receivers to control a pump mounted adjacent said inflatable element.

13. The assembly of claim 12, wherein:

said pump is powered with a power supply.

14. The assembly of claim 12, wherein:

said processor comprising an algorithm to control pressure in said inflatable element using signals from said transmitters.

15. The assembly of claim 12, wherein:

said processor accepts manual input for control of said pump.

16. The assembly of claim 11, wherein:

communication between said transmitter and said receiver is by at least one of acoustic wireless telemetry, electromagnetic based wireless telemetry, electrical wires and/or fiber.

17. The assembly of claim 8, wherein:

said pressure regulation assembly further comprises a processor located adjacent to said inflatable element operably connected to said sensors which detect pressure for local storage of measured pressure data for subsequent analysis when said pressure regulation assembly is removed from a borehole.

18. An inflatable packer assembly, comprising:

a mandrel mounted inflatable element;

a pressure regulation assembly associated with said inflatable element, said pressure regulation assembly comprising at least one sensor outside of the inflatable element to detect borehole pressure or temperature;

a fluid reservoir operably associated with the pressure regulation assembly for supplying inflation fluid to the inflatable element as dictated by the pressure regulation assembly and based at least partially on detected borehole pressure or temperature; and the fluid reservoir includes a fluid separation device having a first side which is exposed to borehole fluid pressure and a second side which is exposed to the inflation fluid, the fluid separation device moving within the fluid reservoir as fluid is supplied or removed from the inflatable element.

* * * * *